United States Patent [19]

Dudley

[11] 4,031,960

[45] June 28, 1977

[54] CIRCULATING VALVE

[75] Inventor: William A. Dudley, Garland, Tex.

[73] Assignee: Teledyne, Inc., Garland, Tex.

[22] Filed: Feb. 25, 1976

[21] Appl. No.: 661,249

[52] U.S. Cl. ..... 166/317; 137/71

[51] Int. Cl.[2] ..... F04F 1/08; E21B 43/12

[58] Field of Search ..... 166/224 R; 137/68 R, 137/71

[56] References Cited

UNITED STATES PATENTS

| | | | |
|---|---|---|---|
| 2,128,253 | 8/1938 | Johnson | 137/68 R |
| 2,919,709 | 1/1960 | Schwegman | 137/68 R |
| 3,282,348 | 11/1966 | Artigue | 166/224 |
| 3,807,428 | 4/1974 | Watkins et al. | 137/71 |

*Primary Examiner*—James A. Leppink
*Attorney, Agent, or Firm*—Vinson & Elkins

[57] ABSTRACT

Disclosed is a circulating valve for use in a well. The circulating valve includes a valve plug initially blocking flow through the valve which moves to a position permitting flow through the valve upon the application of a predetermined pressure differential across the valve plug. This abstract is neither intended to define the scope of the invention, which, of course, is measured by the claims, nor is it intended to be limiting in any way.

33 Claims, 3 Drawing Figures

CIRCULATING VALVE

BACKGROUND OF THE INVENTION

1. Field of the Invention

This invention relates to a circulating valve for use in a well. Circulating valves are used to permit flow between two well conduits.

2. The Prior Art

In the completion or production of a well, a circulating valve if often installed to permit a high volume rate of flow between two of the well conduits. For example, it may be desired to kill a producing well to perform anyone of several operations. A circulating valve controlling flow between the tubing string bore and the annulus around the tubing string would be opened. Fluid would then be circulated through the circulating valve to kill the well.

Generally, circulating valves have been actuated by the use of wireline tools extending from the surface down into the well. For a deep well, the use of wireline tools is expensive, poses a hazard of possible loss of tools in the well, requires time to run the tools into the well, and requires manipulation from the surface to affect opening of the valve.

Some circulating valves are pressure operated. U.S. Pat. No. 3,282,348 to Artigue discloses a pressure operated circulating valve which permits uni-directional flow through the valve and which moves to a closed position preventing any flow through the valve upon the application of a predetermined pressure differential across the valve. U.S. Pat. No. 3,807,428 to Watkins, et al. discloses a circulating valve which is opened upon the application of a predetermined first absolute pressure, and which is closed upon the application of a predetermined second higher absolute pressure.

Neither of the circulating valves disclosed in the above patents permits any condition of flow through the valve once the valve is opened. In addition, the circulating valve disclosed in Watkins et al. '428 would be uncontrollable in the event that tubing pressure could not be controlled from the surface.

OBJECTS OF THE INVENTION

An object of this invention is to provide a circulating valve for use in a well which opens upon a predetermined pressure differential across the valve.

Another object of this invention is to provide a circulating valve for use in a well wherein once the valve is opened by the application of a predetermined pressure differential across the valve, the valve permits any condition of flow therethrough.

Another object of this invention is to provide a circulating valve including a valve plug to control flow through the valve which moves to an out-of-the-way position upon the application of a predetermined pressure differential across the valve.

Another object of this invention is to provide a circulating valve wherein the valve plug moves to a position out of the flow passage through the valve upon the application of predetermined pressure differential across the valve.

These and other objects, and features of advantage of this invention, will be apparent from the drawings, detailed description, and the appended claims.

BRIEF DESCRIPTION OF THE DRAWINGS

In the drawings wherein like numerals indicate like parts and wherein a preferred embodiment of this invention is shown.

DESCRIPTION OF THE PREFERRED EMBODIMENT

In a well, circulating valves provide a means for obtaining a high volume rate of flow between well conduits. The circulating valve of this invention is normally closed but opens upon a predetermined pressure differential across the valve and then remains open to any condition of flow through the valve.

Figure 1:
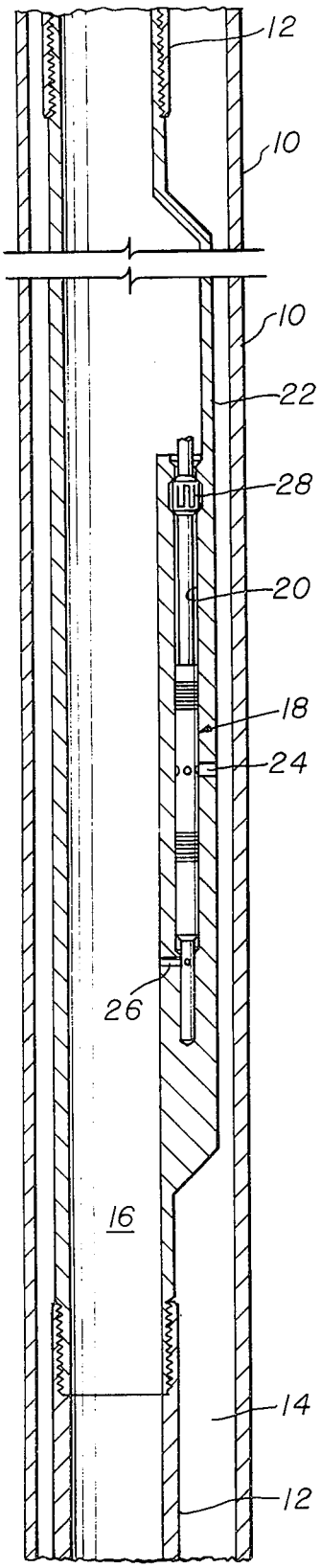
FIG. 1 schematically illustrates, in partial cross section, a circulating valve positioned in a well.

In FIG. 1 a portion of a well for the production of fluids is shown. Into the well extend one or more casing strings 10 to line the well wall. Through the casing string 10 extends a production tubing string 12 through which well fluids may be produced. To control flow between the annulus 14 around the tubing string 12 and the bore 16 of the tubing string 12, a circulating valve, generally indicated at 18, is positioned in the well.

The circulating valve 18 of this invention is adapted to be positioned within the side pocket receptacle 20 of a side pocket mandrel 22 within the production string 12, although other arrangements could be made for positioning the circulating valve 18 in the well. The side pocket mandrel 22 may be conventional and includes a first port 24 communicating between the annulus 14 and the side pocket receptacle 20 and a second port 26 communicating between the bore 16 and the side pocket receptacle 20.

The circulating valve 18 may be held in place within the side pocket receptacle 20 by a latch mechanism 28 capable of maintaining the circulating valve 18 within the side pocket receptacle 20 under an appreciable pressure differential.

Figure 2:
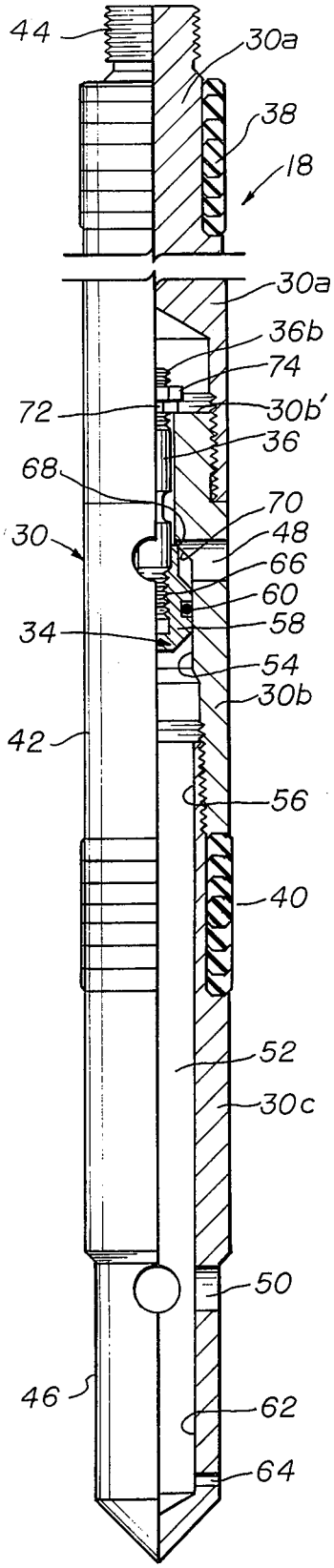
FIG. 2 is a quarter-sectional view of a preferred embodiment of the circulating valve with the valve closed.
Figure 3:
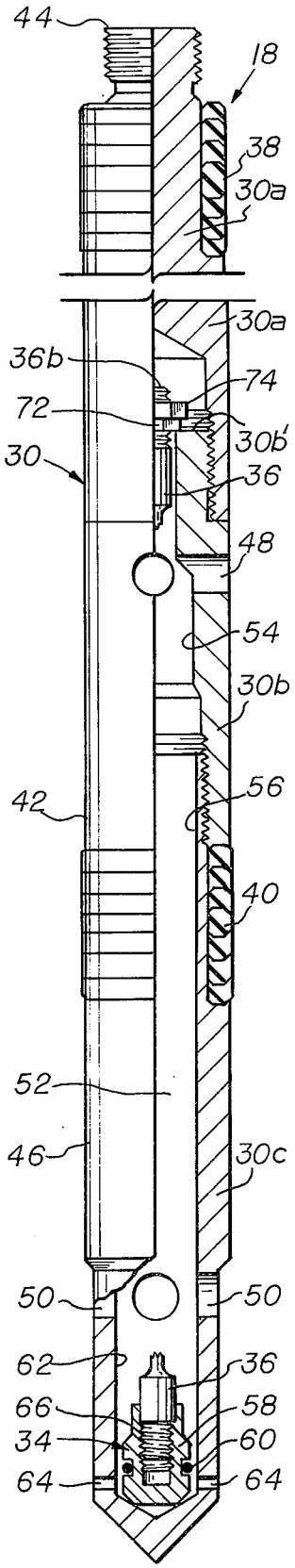
FIG. 3 is a quarter-sectional view of the circulating valve with the valve opened.

The circulating valve 18 is shown in greater detail in FIGS. 2 and 3.

The circulating valve, generally indicated at 18, includes valve housing means 30 adapted to be received within the side pocket, flow passage means through valve housing means 30, valve plug means 34 initially closing flow passage means, and frangible drawbar means 36 to releasably maintain valve plug means 34 in its initial position.

Valve housing means, generally indicated at 30, is adapted to be received within the side pocket receptacle 20 of a side pocket mandrel 22. Valve housing means 30 includes interconnected housing sections **30*a*, 30*b*, and 30*c***.

Surrounding valve housing means 30 are two spaced seal means 38 and 40 which are adapted to seal with the side pocket receptacle 20 of side pocket mandrel 22. The spaced seal means 38 and 40 permit controlled flow of fluids through the circulating valve 18 between ports 24 and 26 of the side pocket mandrel 22 when it is installed within the side pocket receptacle 20. The spaced seal means 38 and 40 define a seal area 42 and an upper 44 and lower 46 end section of valve housing means 30.

Flow passage means extends through valve housing means 30. To permit fluid flow between the tubing bore 16 and the annulus 14 when the circulating valve 18 is opened, one end of flow passage means communicates with the first port 24 in mandrel 22 while the other end of flow passage means 32 communicates with the second port 26 in mandrel 22. Flow passage means includes first circulating port means 48 in valve housing means 30 between the two spaced seal means 38 and 40 adapted to communicate with first port 24, second circulating port means 50 in valve housing means 30 at one end section 46 of valve housing means 30 adapted to communicate with second port 26, and passage means 52 in said valve housing means 30 between said first and second circulating port means 48 and 50. To prevent uncontrolled fluid flow around circulating valve means bypassing flow passage means, first circulating port means 48 is on one side of seal means 40 while second circulating port means 50 is on the other side of seal means 40.

Passage means 52 includes a reduced diameter, seal bore portion 54 in which valve plug means 34 is initially maintained and an enlarged diameter portion 56 to reduce resistance to movement of valve plug means 34 to an out-of-the-way position.

Valve plug means 34 controls fluid flow through flow passage means of the circulating valve 18. Valve plug means 34 includes valve plug body means 58 and circumferential seal means 60 on valve plug body means 58. Seal means 60 is adapted to seal between valve plug body means 58 and the wall of passage means 52 in the seal bore portion 54 when valve plug means 34 is in its initial position.

The circulating valve 18 is designed to be initially closed and to be opened upon a predetermined pressure differential across valve plug means 34. Frangible drawbar means 36 releasably maintains valve plug means 34 in its initial position closing flow passage means. Upon a predetermined pressure differential across valve plug means 34, which in the illustrated circulating valve 18 is applied from the annulus 14 to the tubing string bore 16, frangible drawbar means 36 breaks, permitting valve plug means 34 to move to a position opening flow passage means. The size of frangible drawbar means 36 may be varied from one circulating valve assembly 18 to another to provide that the various circulating valve assemblies open at a different desired pressure differential within a range of pressure differentials. For example, different sized frangible drawbar means 36 may be designed to break in 500 p.s.i. increments within a range of 1,500 p.s.i. to 3,000 p.s.i., differential pressure.

Once frangible drawbar means 36 breaks, valve plug means 34 moves to a position permitting any condition of fluid flow between the tubing bore 16 and the annulus 14 and consequently through flow passage means.

Pocket means 62 is formed within valve housing means 30 to receive valve plug means 34 after frangible drawbar means 36 breaks. The illustrated pocket means 62 is below flow passage means and opens into passage means 52. Valve plug means 34 may thus be blown into pocket means 62 when frangible drawbar means 36 breaks due to the force of the pressure differential across valve plug means 34. Valve plug means will thereafter be maintained in pocket means 62 in an out-of-the-way position, out of flow passage means due to the force of gravity. There it will permit any desired condition of flow through flow passage means.

So that when valve plug means 34 is blown into pocket means 62, its movement is not retarded by fluid that may be within pocket means 62, bleed port means 64 is provided in valve housing means 30 communicating between pocket means 62 and the exterior of valve housing means 30.

The illustrated construction of circulating valve 18 simplifies its assembly and the replacement of parts after use.

To assemble the circulating valve 18, circumferential seal means 60 is positioned around valve plug body means 58 and valve plug body means 54 is connected to frangible drawbar means 36 as by threaded connection 66. Frangible drawbar means 36 with the attached valve plug means 34 is then inserted within valve housing section **30*b* until a shoulder 68 of valve plug body means 64 engages a seat 70 within the housing section 30*b*. At this time frangible drawbar means extends beyond the upper end 30*b*' of housing section 30*b*. A retainer nut 72 is threaded onto the upper end 36*a* of frangible drawbar means 36 until it engages this upper end 30*b*' of valve housing section 30*b*. Care should be taken not to prestress frangible drawbar means 36 as this would cause it to break at an undesired lower pressure differential. A lock nut 74 may also be applied to the upper end 36*b* of the frangible drawbar means 36. Valve plug means 34 is now releasably maintained within the seal bore portion 54 of flow passage means and will seal off passage means 52. Housing section 30*a* and 30*b* may now be connected to housing section 30*b***.

Once the circulating valve 18 has been used, frangible drawbar means 36 is replaced. If flow cutting has worn the seal bore portion 54 of passage means 52, valve housing section **30*b* is also replaced so that an effective seal may be obtained between valve plug body means 58 and the wall of seal bore portion 54 when valve plug means 34** is in its initial position.

In operation, the circulating valve 18 of this invention is used to control flow in a well. Extending through the well would be a casing string 10 and a tubing string 12 defining an annulus 14 therebetween and a bore 16 of the tubing string 12. The circulating valve 18 controls flow between the bore 16 and the annulus 14. The circulating valve 18 could be installed in a side pocket receptacle 20 of a side pocket mandrel 22 utilizing a kickover tool of the type disclosed in U.S. Pat. No. 3,876,001 to Goode, the entire disclosure of which is hereby incorporated by reference.

The circulating valve 18 normally prevents fluid flow between the bore 16 and the annulus 14 through the ports 24 and 26 of the side pocket mandrel 22. However, when it is desired to provide circulation between the bore 16 and the annulus 14 through these ports, fluid pressure is exerted down the annulus 14 until a sufficient pressure differential exists across valve plug means 34 from the annulus 14 to the tubing 16. When a sufficiently high pressure differential has been obtained, frangible drawbar means 36 breaks and valve plug means 34 is blown to a position permitting fluid flow between the tubing bore 16 and the annulus 14. Valve plug means 34 is shown in FIG. 3 in pocket means 62 within the valve housing means 30 where it is out of flow passage means and permits any condition of flow through flow passage means.

Once circulating valve 18 has been opened, any desired condition of fluid flow between the tubing bore 16 and the annulus 14 may be created. For example, the well may be killed by injected well fluids down the annulus 14 through the first circulting port 24 of the side pocket mandrel 22 through the flow passage means of the circulating valve 18, and through the second circulating port 26 of the side pocket mandrel 22 into the tubing bore 16. Thereafter, any desired operation may be performed on the well.

Once the desired operation has been performed, the circulating valve 18 is retrieved from the well. A kick-over tool of the type disclosed in the aforementioned U.S. Pat. No. 3,876,001 may be used to retrieve circulating valve 18.

It will be appreciated that valve plug means 34 provides a sliding valve means when it is releasably maintained in its initial position in the seal bore portion 54 of passage means 52 by frangible drawbar means 36. As a sliding valve means, valve plug means 34 permits incremental elongation of frangible drawbar means 36, as would occur due to pressure variations across valve plug means 34, without permitting fluid flow through passage means 52. Only after frangible drawbar means 36 has elongated until it breaks does the sliding valve means permit flow through passage means 52.

From the foregoing it can be seen that the objects of this invention have been obtained. A circulating valve for use in a well has been provided which opens upon a predetermined pressure differential across the valve. In opening the circulating valve, a valve plug is moved from an initial position blocking fluid flow to a position permitting fluid flow. The valve plug is releasably maintained in its initial position by a frangible drawbar. Once the circulating valve has been opened, any condition of fluid flow through the valve may be provided.

The foregoing disclosure and description of the invention are illustrative and explanatory thereof and various changes in the size, shape, and materials, as well as in the details in the illustrated construction may be made within the scope of the appended claims without departing from the spirit of the invention.

What is claimed is:

1. A circulating valve for use in a well comprising:
valve housing means;
seal means around said valve housing means;
first circulating port means in said valve housing means on one side of said seal means;
second circulating port means in said valve housing means on the other side of said seal means;
passage means in said valve housing means between said first and second circulating port means;
valve plug means movable between an initial position blocking flow through said passage means and a second position permitting flow through said passage means; and
frangible drawbar means to releasably maintain said valve plug means in said initial position.

2. A circulating valve for use in a well comprising:
valve housing means;
seal means around said valve housing means;
first circulating port means in said valve housing means on one side of said seal means;
second circulting port means in said valve housing means on the other side of said seal means;
passage means in said valve housing means between said first and second circulating port means;
valve plug means movable between an initial position blocking flow through said passage means and a second position permitting any condition of flow through said passage means; and
frangible drawbar means to releasably maintain said valve plug means in said initial position.

3. The circulating valve of claim 2 wherein:
said passage means includes:
an upper reduced diameter portion, and
a lower enlarged diameter portion;
said valve plug means includes:
valve plug body means, and
circumferential seal means around said valve plug body means adapted to seal between said valve plug body means and the wall of said passage means in said reduced diameter portion; and
said initial position of said valve plug means is in said reduced diameter portion of said passage means.

4. A circulating valve for use in a well comprising:
valve housing means;
seal means around said valve housing means;
first circulting port means in said valve housing means on one side of said seal means;
second circulating port means in said valve housing means on the other side of said seal means;
passage means in said valve housing means between said first and second circulating port means;
pocket means within said valve housing means out of the flow path between said first and second circulating port means opening into said passage means;
valve plug means movable between an initial position in said passage means blocking flow through said passage means and a second position received within said pocket means; and
frangible drawbar means to releasably maintain said valve plug means in said initial position.

5. The circulating valve of claim 4 wherein:
said frangible drawbar means is adapted to break upon the application of a predetermined pressure differential across said valve plug means.

6. The circulating valve of claim 4 wherein:
said frangible drawbar means is adapted to break upon the application of a predetermined pressure differential across said valve plug means; and
said valve plug means is adapted to be blown into said pocket means when said frangible drawbar means breaks.

7. The circulating valve of claim 4 including:
bleed port means in said valve housing means communicating between said pocket means and the exterior of said valve housing means.

8. The circulating valve of claim 4 wherein:
said passage means includes:
an upper reduced diameter portion, and
a lower enlarged diameter portion;
said valve plug means includes:
valve plug body means, and
circumferential seal means around said valve plug body means adapted to seal between said valve plug body means and the wall of said passage means in said reduced diameter portion; and
said initial position of said valve plug means is in said reduced diameter portion of said passage means.

9. The circulating valve of claim 4 wherein:
said frangible drawbar means is adapted to break upon the application of a predetermined pressure differential across said valve plug means;
bleed port means is included in said valve housing means communicating between said pocket means and the exterior of said valve housing means; and said valve plug means is adapted to be blown into said pocket means when said frangible drawbar means breaks.

10. The circulating valve of claim 4 wherein:
said passage means includes:
an upper reduced diameter portion, and
a lower enlarged diameter portion;
said valve plug means includes:
valve plug and body means, and
circumferential seal means around said valve plug body means adapted to seal between said valve plug body means and the wall of said passage means in said reduced diameter portions;
said initial position of said valve plug means is in said reduced diameter portion of said passage means;
said frangible drawbar means is adapted to break upon the application of a predetermined pressure differential across said valve plug means; and
said valve plug means is adapted to be blown into said pocket means when said frangible drawbar means breaks.

11. The circulating valve of claim 4 wherein:
said passage means includes:
upper reduced diameter portion, and
a lower enlarged diameter portion;
said valve plug means includes:
valve plug body means, and
circumferential seal means around said valve plug body means adapted to seal between said valve plug body means and the wall of said passage means in said reduced diameter portion;
said initial position of said valve plug means is in said reduced diameter portion of said passage means;
said frangible drawbar means is adapted to break upon the application of a predetermined pressure differential across said valve plug means;
bleed port means is included in said valve housing means communicating between said pocket means and the exterior of said valve housing means; and
said valve plug means is adapted to be blown into said pocket means when said frangible drawbar means breaks.

12. A circulating valve for use in a side pocket mandrel of a well comprising:
valve housing means;
two spaced seal means around said valve housing means adapted to seal with the side pocket receptacle of a side pocket mandrel defining a seal area and two end sections of the valve housing means;
first circulating port means in said valve housing means between said spaced seal means;
second circulating port means in said valve housing means at one end section of said valve housing means;
passage means in said housing means between said first and second circulating port means;
valve plug means initially blocking flow through said passage means;
frangible drawbar means to releasably maintain said valve plug means in said initial position; and
pocket means in said valve housing means in which said valve plug means is received after said drawbar means breaks.

13. The circulating valve of claim 12 wherein:
said passage means includes:
an upper reduced diameter portion, and
a lower enlarged diameter portion;
said valve plug means includes:
valve plug body means, and
circumferential seal means around said valve plug body means adapted to seal between said valve plug body means and the wall of said passage means in said reduced diameter portion; and
said initial position of said valve plug means is in said reduced diameter portion of said passage means.

14. The circulating valve of claim 12 wherein:
said frangible drawbar means is adapted to break upon the application of a predetermined pressure differential across said valve plug means.

15. The circulating valve of claim 12 wherein:
said frangible drawbar means is adapted to break upon the application of a predetermined pressure differential across said valve plug means; and
said valve plug means is adapted to be blown into said pocket means when said frangible drawbar means breaks.

16. The circulating valve of claim 12 including:
bleed port means in said valve housing means communicating between said pocket means and the exterior of said valve housing means.

17. The circulating valve of claim 12 wherein:
said frangible drawbar means is adapted to break upon the application of a predetermined pressure differential across said valve plug means;
bleed port means is included in said valve housing means communicating between said pocket means and the exterior of said valve housing means; and
said valve plug means is adapted to be blown into said pocket means when said frangible drawbar means breaks.

18. The circulating valve of claim 12 wherein:
said passage means includes:
an upper reduced diameter portion, and
a lower enlarged diameter portion;
said valve plug means includes:
valve plug and body means, and
circumferential seal means around said valve plug body means adapted to seal between said valve plug body means the wall of said passage means in said reduced diameter portions;
said initial position of said valve plug means is in said reduced diameter portion of said passage means;
said frangible drawbar means is adapted to break upon the application of a predetermined pressure differential across said valve plug means; and
said valve plug means is adapted to be blown into said pocket means when said frangible drawbar means breaks.

19. The circulating valve of claim 12 wherein:
said passage means includes:
upper reduced diameter portion, and
a lower enlarged diameter portion;
said valve plug means includes:
valve plug body means, and
circumferential seal means around said valve plug body means adapted to seal between said valve plug body means and the wall of said passage means in said reduced diameter portion;
said initial position of said valve plug means is in said reduced diameter portion of said passage means;

said frangible drawbar means is adapted to break upon the application of a predetermined pressure differential across said valve plug means;

bleed port means is included in said valve housing means communicating between said pocket means and the exterior of said valve housing means; and said valve plug means is adapted to be blown into said pocket means when said frangible drawbar means breaks.

20. A circulating valve for use in a side pocket mandrel of a well comprising:

valve housing means;

two spaced seal means around said valve housing means adapted to seal with the side pocket receptacle of a side pocket mandrel defining a seal area, an upper end section and a lower end section of said valve housing means;

first circulating port means in said seal area of said valve housing means;

second circulating port means in said lower end section of said valve housing means;

passage means in said housing means between said first and second circulating port means;

pocket means below said passage means opening into said passage means;

valve plug means movable between an initial position in said passage means blocking flow through said passage means and a second position received within said pocket means;

frangible drawbar means to releasably maintain said valve plug means in said initial position.

21. The circulating valve of claim 20 wherein:

said passage means includes:

an upper reduced diameter portion, and a lower enlarged diameter portion;

said valve plug means includes:

valve plug body means, and circumferential seal means around said valve plug body means adapted to seal between said valve plug body means and the wall of said passage means in said reduced diameter portion; and said initial position of said valve plug means is in said reduced diameter portion of said passage means.

22. The circulating valve of claim 20 wherein:

said frangible drawbar means is adapted to break upon the application of a predetermined pressure differential across said valve plug means.

23. The circulating valve of claim 20 wherein:

said frangible drawbar means is adapted to break upon the application of a predetermined pressure differential across said valve plug means; and said valve plug means is adapted to be blown into said pocket means when said frangible drawbar means breaks.

24. The circulating valve of claim 20 including:

bleed port means in said valve housing means communicating between said pocked means and the exterior of said valve housing means at said other side of said seal means.

25. The circulating valve of claim 20 wherein:

said frangible drawbar means is adapted to break upon the application of a predetermined pressure differential across said valve plug means;

bleed port means is included in said valve housing means communicating between said pocket means and the exterior of said valve housing means; and said valve plug means is adapted to be blown into said pocket means when said frangible drawbar means breaks.

26. The circulating valve of claim 20 wherein:

said passage means includes:

an upper reduced diameter portion, and a lower enlarged diameter portion;

said valve plug means includes:

valve plug and body means, and circumferential seal means around said valve plug body means adapted to seal between said valve plug body means and the wall of said passage means in said reduced diameter portions;

said initial position of said valve plug means is in said reduced diameter portion of said passage means;

said frangible drawbar means is adapted to break upon the application of a predetermined pressure differential across said valve plug means; and said valve plug means is adapted to be blown into said pocket means when said frangible drawbar means breaks.

27. The circulating valve of claim 20 wherein:

said passage means includes:

upper reduced diameter portion, and a lower enlarged diameter portion;

said valve plug means includes:

valve plug body means, and circumferential seal means around said valve plug body means adapted to seal between said valve plug body means and the wall of said passage means in said reduced diameter portion;

said initial position of said valve plug means is in said reduced diameter portion of said passage means;

said frangible drawbar means is adapted to break upon the application of a predetermined pressure differential across said valve plug means;

bleed port means is included in said valve housing means communicating between said pocket means and the exterior of said valve housing means; and said valve plug means is adapted to be blown into said pocket means when said frangible drawbar means breaks.

28. A circulating valve for use in a well comprising:

valve housing means;

seal means around said valve housing means;

first circulating port means in said valve housing means on one side of said seal means;

second circulating port means in said valve housing means on the other side of said seal means;

passage means in said valve housing means between said first and second circulating port means;

sliding valve means movable between an initial position blocking flow through said passage means and a second position permitting flow through said passage means;

frangible drawbar means to releasably maintain said sliding valve means in said initial position.

29. A circulating valve for use in a well comprising:

valve housing means;

seal means around said valve housing means;

first circulating port means in said valve housing means on one side of said seal means;

second circulating port means in said valve housing means on the other side of said seal means;

passage means in said valve housing means between said first and second circulating port means;

pocket means in said valve housing means out of the flow path between said first and second circulating port means opening into said passage means;

sliding valve means movable between an initial position blocking flow through said passage means and a second position received within said pocket means; and frangible drawbar means to releasably maintain said valve plug means in said initial position.

30. A circulating valve for use in a well comprising:

valve housing means;

seal means around said valve housing means;

first circularing port means in said valve housing means on one side of said seal means;

second circulating port means in said valve housing means on the other side of said seal means;

passage means in said valve housing means between said first and second circulating port means;

valve plug means movable between an initial position blocking flow through said passage means and a second position permitting any condition of flow through said passage means;

frangible draw bar means for releasably maintaining said valve plug means in said initial position;

means for maintaining one end of said frangible draw bar means fixed with respect to said valve housing means; and means for connecting the other end of said frangible draw bar means to said valve plug means.

31. A circulating valve for one use in a well comprising:

valve housing means;

seal means around said valve housing means;

first circulating port means in said valve housing means on one side of said seal means;

second circulating port means in said valve housing means on the other side of said seal means;

passage means in said valve housing means between said first and second circulating port means;

pocket means within said valve housing means, positioned on one side of said second circulating port means and out of the flow path between said first and second circulating port means and opening into said passage means;

valve plug means movable between an initial position in said passage means blocking flow through said passage means and a second position received within said pocket means;

frangible draw bar means for releasably maintaining said valve plug means in said initial position;

shoulder means in said valve housing means on the other side of said second circulating port means;

means on one end of said frangible draw bar means for engaging said shoulder means;

means on the other end of said frangible draw bar means for connecting to said valve plug means; and said frangible draw bar means breaking due to an axial tension load resulting from the application of a sufficient pressure differential across said valve plug means applied from said first circulating port means to said second circulating port means.

32. A circulating valve for use in a side pocket mandrel of a well comprising:

valve housing means;

two spaced seal means around said valve housing means adapted to seal with the side pocket receptacle of a side pocket mandrel and defining a seal area and two end sections of the valve housing means;

first circulating port means in said valve housing means between said spaced seal means;

second circulating port means in said valve housing means at one end section of said valve housing means;

passage means in said valve housing means between said first and second circulating port means;

valve plug means initially blocking flow through said passage means;

frangible draw bar means for releasably maintaining said valve plug means in said initial position;

pocket means in said valve housing means and positioned on one side of said second circulating port means for receiving said valve plug means after said frangible draw bar means breaks;

shoulder means in said valve housing means on the other side of said second circulating port means;

means on one end of said frangible draw bar means for engaging said shoulder means;

means on the other end of said frangible draw bar means for connecting to said valve plug means; and said frangible draw bar means breaking due to an axial tension load resulting from the application of a pressure differential across said valve plug means applied from said first circulating port means to said second circulating port means.

33. A circulating valve for use in a well comprising:

valve housing means;

seal means around said valve housing means;

first circulating port means in said valve housing means on one side of said seal means;

second circulating port means in said valve housing means on the other side of said seal means;

passage means in said valve housing means between said first and second circulating port means;

pocket means in said valve housing means and positioned on one side of said second circulating port means and out of the flow path of said first and second circulating port means and opening into said passage means;

sliding valve means movable between an initial position blocking flow through said passage means and a second position received within said pocket means;

frangible draw bar means to releasably maintain said sliding valve means in said initial position;

shoulder means in said valve housing means on the other side of said second circulating port means;

means on one end of said frangible draw bar means for engaging said shoulder means;

means on the other end of said frangible draw means for connecting to said valve plug means; and said frangible draw means breaking due to an axial tension load resulting from the application of a pressure differential across said sliding valve means applied from said first circulating port means to said second circulating port means.

* * * * *

UNITED STATES PATENT OFFICE

CERTIFICATE OF CORRECTION

Patent No. 4,031,960 Dated June 28, 1977

Inventor(s) William A. Dudley

It is certified that error appears in the above-identified patent and that said Letters Patent are hereby corrected as shown below:

Column 1, line 11 - delete "if" and insert -- is --.

Column 5, line 1 - delete "circulting" and insert -- circulating --.

Claim 2, line 6 - delete "circulting" and insert -- circulating --.

Claim 4, line 4 - delete "circulting" and insert -- circulating --.

Claim 24, line 3 - delete "pocked" and insert -- pocket --.

Claim 30, line 4 - delete "circularing" and insert -- circulating --.

Claim 31, line 1 - delete "one".

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*